US006096370A

United States Patent [19]

Mori et al.

[11] Patent Number: 6,096,370

[45] Date of Patent: Aug. 1, 2000

[54] METHOD AND APPARATUS FOR PRODUCING A GREEN SHEET WITH AN EVEN THICKNESS

[75] Inventors: Haruhiko Mori; Yutaka Iseki; Makota Muranaka, all of Fukui-ken, Japan

[73] Assignee: Murata Manufacturing Co., Ltd., Nagaokakyo, Japan

[21] Appl. No.: 09/150,004

[22] Filed: Sep. 9, 1998

[30] Foreign Application Priority Data

Sep. 9, 1997 [JP] Japan ..... 9-243593

[51] Int. Cl.[7] ..... B05D 3/14; B05C 11/00

[52] U.S. Cl. ..... 427/9; 427/10; 427/356; 264/650; 264/40.7; 118/712; 118/410

[58] Field of Search ..... 427/9, 10, 356; 118/410, 712, 683, 684; 264/650, 40.7, 40.1

[56] References Cited

U.S. PATENT DOCUMENTS

| | | | |
|---|---|---|---|
| 4,426,239 | 1/1984 | Upmeier | 427/9 |
| 4,836,134 | 6/1989 | Knop | 118/410 |
| 5,418,004 | 5/1995 | Chin et al. | 118/410 |
| 5,756,163 | 5/1998 | Watanabe | 427/430.1 |

FOREIGN PATENT DOCUMENTS

| | | |
|---|---|---|
| 3-203601 | 9/1991 | Japan . |
| 6-238155 | 8/1994 | Japan . |
| 7-204561 | 8/1995 | Japan . |

*Primary Examiner*—Katherine A. Bareford
*Attorney, Agent, or Firm*—Burns, Doane, Swecker & Mathis, LLP

[57] ABSTRACT

The present invention is to produce a ceramic green sheet with an even thickness. By supplying a ceramic slurry to a slurry room comprising a slurry coater, contacting a carrier film to the fringe part of an opening of the slurry room with pressure so as to close the opening, and moving the carrier film along the opening in the state, a ceramic green sheet made from the slurry can be formed on the carrier film. At the time, based on the actual flow rate data on the actual flow rate of the slurry measured by the flow meter and the actual thickness data on the actual thickness of the green sheet measured by the film thickness meter, appropriate flow rate data on the appropriate flow rate of the slurry to be supplied for obtaining a green sheet with a desired thickness are sought in an appropriate flow rate data calculating means so that the flow rate of the slurry is controlled by the flow rate controlling means based thereon.

12 Claims, 1 Drawing Sheet

METHOD AND APPARATUS FOR PRODUCING A GREEN SHEET WITH AN EVEN THICKNESS

BACKGROUND OF THE INVENTION

1. Field of the Invention

The present invention relates to a production method and a production apparatus of a ceramic green sheet. More specifically, it relates to a method and an apparatus for producing a ceramic green sheet with a carrier film lined thereon.

2. Description of the Related Art

In producing a laminated ceramic electronic part such as a laminated ceramic capacitor, ceramic green sheets are laminated. In order to achieve a high performance as well as a smaller size or a thinner shape of the laminated ceramic electronic part, it is effective to have the ceramic green sheets as a thin layer.

On the other hand, a ceramic green sheet is mechanically weak. Therefore, in the case of the above-mentioned thin layer, a flexible carrier film is prepared to be applied with a ceramic slurry for forming a ceramic green sheet in order to compensate the mechanical strength. The method uses a doctor blade to apply the ceramic slurry, and hence, may be referred to as the doctor blade method. And further, the ceramic green sheet is handled in a state lined with the carrier film in the subsequent steps.

As mentioned above, a doctor blade method has been used conventionally for forming a ceramic green sheet on a carrier film.

However, the above-mentioned doctor blade method involves a problem in that a comparatively large irregularity tends to generate in terms of the thickness of the obtained ceramic green sheets because the thickness of the obtained ceramic green sheets fluctuates according to the physical property of the ceramic slurry, such as the viscosity, the specific gravity, and the solid component concentration, and according to the liquid level change in the tank for storing the ceramic slurry to be supplied to the doctor blade part by the ceramic slurry consumption.

On the other hand, as a method for forming a coat film such as an adhesive on a carrier film, a method of using a slurry coater comprising a slurry room provided with an opening toward the outside for receiving a coating liquid (slurry) supply with a doctor edge formed along one side rim of the opening has been considered. According to the method, a coat film of a slurry can be formed on a carrier film by supplying the slurry to the slurry room and pressing the carrier film to the fringe part of the opening of the slurry room so as to close the opening, and moving the carrier film along the opening such that the doctor edge exists at the downstream side.

In this method, since the internal pressure of the slurry room is one factor to influence the coat film thickness to be formed on the carrier film, it is important to constantly maintain the pressure in the slurry room for evening the coat film thickness.

Therefore, a method of constantly maintaining the pressure in the slurry room by providing a pressure sensor in the slurry room for always measuring the pressure in the slurry room so that the pressure on the slurry to be sent into the slurry room can be controlled based on the measurement result can be considered.

However, if the pressure of the slurry to be sent is controlled based on the measurement result by the pressure sensor as mentioned above, since the pressure sensor is provided inside the slurry room, the pressure sensor tends to function too sensitively so that the pressure of the slurry to be supplied to the slurry room is frequently changed, resulting in an inconvenience that the coat film thickness fluctuates therefor.

Accordingly, if this method of using a slurry coater is to be adopted as a method for forming a ceramic green sheet on a carrier film, it is disadvantageous in that the film thickness irregularity of the green sheets is large so that a laminated ceramic electronic part cannot be obtained with stable characteristics. The smaller the electronic part is, the larger the disadvantage is.

SUMMARY OF THE INVENTION

Accordingly, in order to solve the above-mentioned problems, an object of the present invention is to provide a production method and a production apparatus of a ceramic green sheet, capable of producing the ceramic green sheet with an even thickness.

A production method of a ceramic green sheet according to the present invention comprises the steps of:

- preparing a slurry coater for receiving the ceramic slurry supply, provided with an opening toward the outside with a doctor edge formed along one side rim of the opening,
- preparing a carrier film for forming a ceramic green sheet made from the ceramic slurry thereon, and
- forming a ceramic green sheet made from the ceramic slurry on the carrier film by supplying the ceramic slurry to the slurry room and pressing the carrier film to the fringe part of the opening of the slurry room so as to close the opening, and moving the carrier film along the opening such that the doctor edge exists at the downstream side;
- further comprising the steps of:
  - measuring the flow rate of the ceramic slurry actually supplied to the slurry room and measuring the thickness of the ceramic green sheet actually formed on the carrier film,
  - seeking data on an appropriate flow rate of the ceramic slurry to be supplied to the slurry room for obtaining a ceramic green sheet with a desired thickness based on the measured actual data on the ceramic slurry flow rate and the measured actual data on the ceramic green sheet thickness, and
  - controlling the flow rate of the ceramic slurry to be supplied to the slurry room based on the appropriate flow rate data for solving the above-mentioned technological problems.

In the slurry coater to be used in a production method of a ceramic green sheet according to the present invention, it is preferable that the slurry room comprises a first slurry room, a slurry channel communicating with the first slurry room, having a cross-section smaller than that of the first slurry room, and a second slurry room communicating with the slurry channel, having a cross-section larger than that of the slurry channel so that the ceramic slurry supply is received at the first slurry room and the opening is formed in the second slurry room.

On the other hand, a production apparatus of a ceramic green sheet according to the present invention is for implementing the above-mentioned production method. The production apparatus comprises a slurry coater having a slurry room provided with an opening toward the outside for receiving a slurry supply with a doctor edge formed along one side rim of the opening, a carrier film holding member for holding a carrier film for forming a ceramic green sheet made from the ceramic slurry thereon such that the carrier film is pressed to the fringe part of the opening of the slurry room so as to close the opening, and is moved along the opening such that the doctor edge exists at the downstream side, a flow rate measuring means for measuring the flow rate of the ceramic slurry actually supplied to the slurry room, a thickness measuring means for measuring the thickness of the ceramic green sheet actually formed on the carrier film, an appropriate flow rate data calculating means for seeking data on the appropriate flow rate of the ceramic slurry to be supplied to the slurry room for obtaining a ceramic green sheet with a desired thickness based on the measured actual flow rate data on the ceramic slurry flow rate measured by the flow rate measuring means and the actual thickness data on the ceramic slurry thickness measured by the thickness measuring means, and a flow rate controlling means for controlling the flow rate of the ceramic slurry to be supplied to the slurry room based on the appropriate flow rate data.

In the production apparatus of a ceramic green sheet according to the present invention, it is preferable that the slurry room comprises a first slurry room, a slurry channel communicating with the first slurry room, having a cross-section smaller than that of the first slurry room, and a second slurry room communicating with the slurry channel, having a cross-section larger than that of the slurry channel so that the ceramic slurry supply is received at the first slurry room and the opening is formed in the second slurry room.

Further, in the production apparatus of a ceramic green sheet according to the present invention, it is preferable that the flow rate measuring means includes a mass flow meter, the thickness measuring means includes a non-contact type film thickness-meter such as X-ray, b-ray, and laser, and the carrier film holding member includes a backing roll disposed such that the opening can be closed by pressing the carrier film onto the fringe part of the opening of the slurry room while keeping the carrier film on the peripheral surface thereof, for moving the carrier film in the direction such that the doctor edge exists at the downstream side.

According to the production method of a ceramic green sheet according to the present invention, the flow rate of the ceramic slurry actually supplied to the slurry room of the slurry coater is measured and the thickness of the ceramic green sheet actually formed on the carrier film is measured so that data on an appropriate flow rate of the ceramic slurry to be supplied to the slurry room for obtaining a ceramic green sheet with a desired thickness can be sought based on the measured actual data on the ceramic slurry flow rate and the measured actual data on the ceramic green sheet thickness, and the flow rate of the ceramic slurry to be supplied to the slurry room is controlled based on the appropriate flow rate data. Therefore, since the flow rate can be controlled at a position relatively away from the slurry room, an excessive control cannot be provoked. Further, since the thickness of the ceramic green sheet actually formed on the carrier film can be controlled while monitoring the thickness, control can be conducted with a high accuracy, and continuation of producing ceramic green sheets with an undesired thickness can be prevented. By adopting the production method to a laminated ceramic electronic part, it can contribute to stabilization of the characteristics and downsizing of the device.

Since the slurry room comprises a first slurry room, a slurry channel communicating with the first slurry room, having a cross-section smaller than that of the first slurry room, and a second slurry room communicating with the slurry channel, having a cross-section larger than that of the slurry channel so that the ceramic slurry supply is received at the first slurry room and the opening is formed in the second slurry room in a slurry coater used in a production method of a ceramic green sheet according to the present invention, the influence of irregularity of the pulse of the pump for supplying the ceramic slurry to the first slurry room can be avoided in the second slurry room so that the internal pressure in the second slurry room can be maintained constantly at a high level. Therefore, this can also contribute to the even thickness of the ceramic green sheet.

On the other hand, according to the production apparatus of a ceramic green sheet according to the present invention, since a flow rate measuring means for measuring the flow rate of the ceramic slurry actually supplied to the slurry room, a thickness measuring means for measuring the thickness of the ceramic green sheet actually formed on the carrier film, an appropriate flow rate data calculating means for seeking data on the appropriate flow rate of the ceramic slurry to be supplied to the slurry room for obtaining a ceramic green sheet with a desired thickness based on the measured actual flow rate data on the ceramic slurry flow rate measured by the flow rate measuring means and the actual thickness data on the ceramic slurry thickness measured by the thickness measuring means, and a flow rate controlling means for controlling the flow rate of the ceramic slurry to be supplied to the slurry room based on the appropriate flow rate data are provided and the flow rate controlling means can be provided relatively away from the slurry room, the effects the same as the effects of the above-mentioned production method can be provided by producing a ceramic green sheet with the production apparatus.

Furthermore, since the slurry room comprises a first slurry room, a slurry channel communicating with the first slurry room, having a cross-section smaller than that of the first slurry room, and a second slurry room communicating with the slurry channel, having a cross-section larger than that of the slurry channel so that the ceramic slurry supply is received at the first slurry room and the opening is formed in the second slurry room in the production apparatus of a ceramic green sheet according to the present invention, the influence of irregularity of the pulse of the pump for supplying the ceramic slurry to the first slurry room can be avoided in the second slurry room so that the internal pressure in the second slurry room can be maintained constantly at a high level. Therefore, this can also contribute to the even thickness of the ceramic green sheet.

Further, since the flow rate measuring means includes a mass flow meter in the production apparatus of a ceramic green sheet according to the present invention, since the mass flow meter can measure the mass passing thereby per a unit time, an accurate measurement can be conducted without trouble even if the ceramic slurry pressure fluctuated due to the fluctuation of the specific gravity, the viscosity, and the like, of the ceramic slurry, or the liquid level change of the ceramic slurry by the ceramic slurry consumption, and the like, in supplying the ceramic slurry from the slurry tank.

Moreover, since the thickness measuring means includes a non-contact type film thickness meter in the production apparatus of a ceramic green sheet according to the present invention, the thickness can be measured highly accurately with respect to the ceramic green sheet so that it can contribute to a further accurate thickness control of the ceramic green sheet.

Further, since a backing roll is provided for keeping the carrier film on the peripheral surface thereof as the carrier film holding member for holding a carrier film such that the carrier film is pressed to the fringe part of the opening of the slurry room so as to close the opening, and is moved along the opening such that the doctor edge exists at the downstream side, the carrier film can be maintained stably for closing the opening by the contact with pressure, and the carrier film can be moved as desired according to the rotation of the backing roll. Furthermore, by changing the distance between the backing roll and the doctor edge, the thickness of the ceramic green sheet to be obtained can be changed easily.

DESCRIPTION OF THE PREFERRED EMBODIMENT

Figure 1:
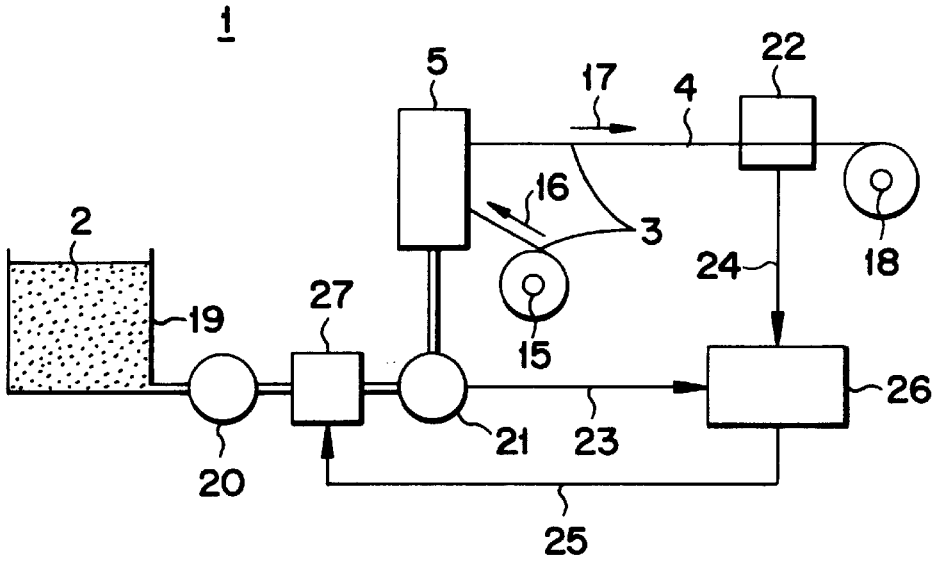
FIG. 1 is a block diagram for explaining a production method and a production apparatus of a ceramic green sheet according to one embodiment of the present invention, schematically showing a production apparatus 1, forming the ceramic green sheet.
Figure 2:
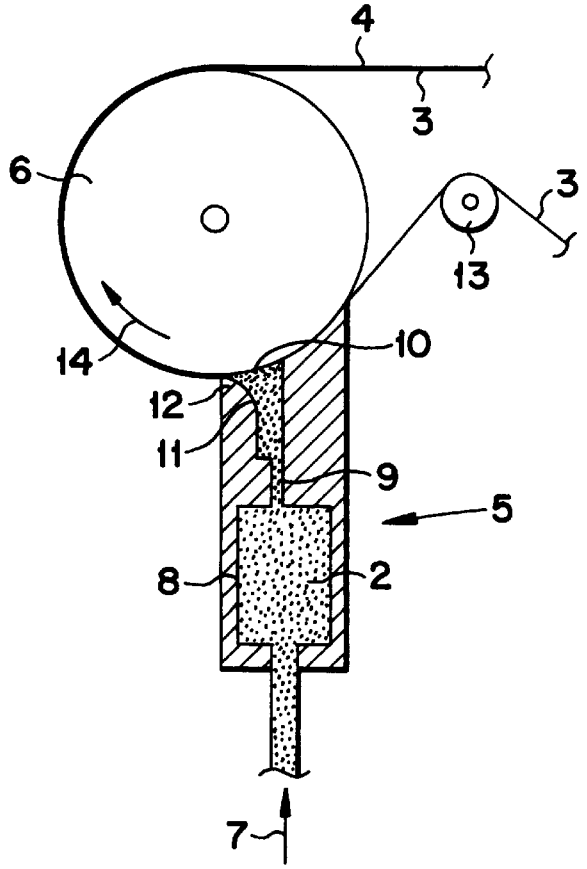
FIG. 2 is a cross-sectional view schematically showing a slurry coater 5 shown in FIG. 1 and a backing roller 6 provided in relation thereto.

FIGS. 1 and 2 are for explaining a production method and a production apparatus of a ceramic green sheet according to one embodiment of the present invention in the state of producing a ceramic green sheet.

FIG. 1 shows the entire configuration of the production apparatus 1 including a controlling system. As shown in FIG. 1, the production apparatus 1 is for applying a ceramic slurry 2 onto a carrier film 3 so that a ceramic green sheet 4 can be formed on the carrier film 3, comprising a slurry coater 5 for applying the ceramic slurry 2 onto the carrier film 3. FIG. 2 shows the slurry coater 5 and a backing roll 6 provided in relation thereto.

With reference to FIG. 2, the configuration of the slurry coater 5 and the backing roll 6 will be explained.

The slurry coater 5 comprises a first slurry room 8 for receiving the supply of the ceramic slurry 2 shown by the arrow 7 to be sent with pressure, a slurry channel 9 communicating with the first slurry room 8, having a cross-section smaller than that of the first slurry room 8, and a second slurry room 11 communicating with the slurry channel 9, having a cross-section larger than that of the slurry channel 9, provided with an opening 10 toward the outside formed therein. A doctor edge 12 is formed at the fringe part of the opening 10 along one side rim thereof.

In the slurry coater 5, the ceramic slurry 2 supplied to the first slurry room 8 is supplied to the second slurry room 11 via the slurry channel 9. By accordingly supplying the ceramic slurry 2 from the first slurry room 8 to the second slurry room 11 through the slurry channel 9 having a comparatively small cross-section, the internal pressure of the second slurry room 11 can easily be maintained constantly at a high level.

It is preferable that aggregate particles having a particle size 10 times as large as the average particle size of the ceramic powders contained in the ceramic slurry 2 or more are preliminarily eliminated from the ceramic slurry 2 to be sent to the first slurry room 8 with pressure. Therefor, an absolute percolating filter capable of securely gathering aggregate particles having a particle size 10 times as large as the average particle size of the ceramic powders or more is used so that a ceramic slurry percolated by the filter can only be supplied to the first slurry room 8 as the ceramic slurry 2.

On the other hand, the backing roll 6, which serves as a carrier film holding member, is disposed such that the opening 10 can be closed by contacting the carrier film 3 to the fringe part of the opening 10 of the second slurry room 11 with pressure while keeping the carrier film 3 on the peripheral surface thereof. The carrier film 3 is supplied to the peripheral surface of the backing roll 6 via a guide roll 13 so as to be moved in the direction such that the doctor edge 12 exists at the downstream side by the backing roll 6 rotation in the arrow 14 direction.

In the configuration heretofore mentioned, the ceramic slurry 2 is sent to the first slurry room 8 with pressure, and then, is supplied to the second slurry room 11 via the slurry channel 9. On the other hand, the carrier film 3 placed on the peripheral surface of the backing roll 6 moves along the opening 10 of the second slurry room 11 according to the backing roll 6 rotation while closing the opening 10 of the second slurry room 11. Therefore, when the carrier film 3 passes the doctor edge 12, the ceramic slurry 2 in the second slurry room 11 is applied to the carrier film 3 by the pressure from the doctor edge 12. Accordingly, a ceramic green sheet 4 made from the ceramic slurry 2 can be formed on the carrier film 3.

As shown in FIG. 1, the carrier film 3 to be conveyed to the slurry coater 5 is prepared in a state wound around a supply reel 15. Then it is pulled out therefrom in the arrow 16 direction so as to be supplied to the peripheral surface of the backing roll 6. After passing the slurry coater 5, the ceramic green sheet 4 formed on the carrier film 3 is dried while being conveyed in the arrow 17 direction. Thereafter, it is taken up on a winding reel 18 with the carrier film 3.

As shown in FIG. 1, the ceramic slurry 2 to be supplied to the first slurry room 8 is sent from a slurry tank 19 via a pump 20 with pressure.

The thickness of the ceramic green sheet 4 formed as mentioned above can be adjusted basically by altering the distance between the backing roll 6 and the doctor edge 12. However, the thickness of the obtained ceramic green sheet 4 can fluctuate, for example, by the internal pressure change in the second slurry room 11 or the change of the viscosity, the specific gravity, the solid component concentration, and the like, of the ceramic slurry 2 to be used.

In order to produce a ceramic green sheet 4 with an even thickness by preventing the thickness fluctuation of the ceramic green sheet, the below-mentioned configuration is adopted in this embodiment.

As shown in FIG. 1, a flow meter 21 is disposed in the supply path of the ceramic slurry 2 from the pump 20 to the slurry coater 5 as the flow rate measuring means for measuring the flow rate of the ceramic slurry 2 actually supplied to the first slurry room 8 (see FIG. 2). As the flow meter 21, an electromagnetic flow meter, a Coriolis type mass flow meter, a supersonic flow meter, and a differential flow meter can be used advantageously.

Further, a film thickness meter 22 is provided in relation to the conveyance path of the ceramic green sheet 4 in the arrow 17 direction as the thickness measuring means for measuring the thickness of the ceramic green sheet 4 actually formed on the carrier film 3. As the film thickness meter 22, it is preferable to utilize a non-contact type thickness measuring technology, such as laser displacement, radioactive ray, and capacitance change.

An appropriate flow rate data calculating means 26 is provided for seeking appropriate flow rate data 25 on the appropriate flow rate of the ceramic slurry 2 to be supplied to the first slurry room 8 for obtaining a ceramic green sheet with a desired thickness based on the actual flow rate data 23 on the flow rate of the ceramic slurry 2 measured by the flow meter 21 and the actual thickness data 24 on the thickness of the ceramic green sheet 4 measured by the film thickness meter 22. The appropriate flow rate data calculating means 26 can comprise, for example, a personal computer.

A flow rate controlling means 27 for controlling the flow rate of the ceramic slurry 2 to be supplied to the first slurry room 8 based on the above-mentioned appropriate flow rate data 25 is provided in the ceramic slurry 2 supply path from the pump 20 to the flow rate meter 21. The flow rate controlling means 27 can comprise, for example, a valve. When the ceramic slurry 2 is sent with pressure without using a pump 20, but by applying a backing pressure to the slurry tank 19, a means for controlling the backing pressure serves as the flow rate controlling means. Furthermore, when a rotation pump such as a gear pump is used as the pump 20, a means for controlling the rotational frequency of the rotation pump serves as the flow rate controlling means.

The controlling system functions in the ceramic green sheet production apparatus 1 as follows.

The flow rate of the ceramic slurry 2 actually supplied to the first slurry room 8 is measured by the flow rate meter 21 as well as the thickness of the ceramic green sheet 4 actually formed on the carrier film 3 is measured by the film thickness meter 22.

The actual flow rate data 23 on the flow rate of the ceramic slurry 2 and the actual thickness data 24 on the thickness of the ceramic green sheet 4 accordingly measured are inputted to the appropriate flow rate data calculating means 26. Appropriate flow rate data 25 on the appropriate flow rate of the ceramic slurry 2 to be supplied to the first slurry room 8 for obtaining a ceramic green sheet 4 with a desired thickness are sought in the appropriate flow rate data calculating means 26 based on the actual flow rate data 23 and the actual thickness data 24. In order to seek the appropriate flow rate data 25, the relationship between the specific gravity and the flow rate of the ceramic slurry 2, the width and the targeted thickness of the ceramic green sheet 4, and the flow rate data of the ceramic slurry 2 to be needed according to the moving rate of the carrier film 3 are calculated in advance so that the flow rate data are stored in the appropriate flow rate data calculating means 26.

The above-mentioned appropriate flow rate data 25 are inputted to the flow rate controlling means 27. The flow rate controlling means 27 controls the flow rate of the ceramic slurry 2 to be supplied to the first slurry room 8 based on the appropriate flow rate data 25.

As mentioned above, this embodiment is for adjusting the flow rate of the ceramic slurry 2 by the feedback control of the flow rate controlling means 27 disposed relatively away from the second slurry room 11 according to the actual flow rate data 23 and the actual thickness data 24 on the actual flow rate and the actual thickness obtained by measuring the flow rate of the ceramic slurry 2 actually supplied to the first slurry room 8 and the thickness of the ceramic green sheet 4 actually formed on the carrier film 3. Therefore, an excessive control cannot be provoked unlike the above-mentioned case where the pressure sensor is provided in the slurry room (corresponding to the second slurry room 11) for always measuring the pressure in the slurry room so that the pressure of the slurry to be sent into the slurry room is controlled for constantly maintaining the pressure in the slurry room based on the measurement result for evening the coat film thickness thereby. Moreover, since the thickness is controlled while monitoring the thickness of the ceramic green sheet 4 actually formed on the carrier film 3, control can be conducted with a high accuracy. Besides, continuation of ceramic green sheets with an undesired thickness can be prevented.

What is claimed is:

1. A method for producing a ceramic green sheet comprising the steps of:

preparing a slurry coater for receiving a ceramic slurry supply, the slurry coater includes an opening toward an outside of the slurry coater and a doctor edge formed along one side rim of the opening at a fringe part of the opening;

preparing a carrier film for forming a ceramic green sheet;

forming a ceramic green sheet made from the ceramic slurry on the carrier film by supplying the ceramic slurry to a slurry room, the slurry room opens onto the opening toward the outside of the slurry coater, and pressing the carrier film to the fringe part of the opening of the slurry room so as to close the opening, and moving the carrier film along the opening such that the doctor edge exists at the downstream side;

measuring the flow rate of the ceramic slurry actually supplied to the slurry room;

measuring the thickness of the ceramic green sheet actually formed on the carrier film;

collecting the measured data on the actual flow rate of the ceramic slurry and the actual thickness of the ceramic green sheet and determining an appropriate flow rate of the ceramic slurry to be supplied to the slurry room for obtaining a ceramic green sheet with a desired thickness based on the measured actual data on the ceramic slurry flow rate and the measured actual data on the ceramic green sheet thickness; and controlling the flow rate of the ceramic slurry to be supplied to the slurry room based on the appropriate flow rate data.

2. The method for producing a ceramic green sheet according to claim 1, wherein the slurry room comprises a first slurry room, a slurry channel communicating with the first slurry room, the slurry channel having a cross-section smaller than that of the first slurry room, and a second slurry room communicating with the slurry channel, the second slurry room having a cross-section larger than that of the slurry channel so that the ceramic slurry supply is received at the first slurry room and the opening is formed in the second slurry room.

3. An apparatus for producing a ceramic green sheet comprising:

a slurry coater having a slurry room provided with an opening toward an outside of the slurry coater, the slurry coater receives a slurry supply, the slurry coater also includes a doctor edge formed along a fringe part of one side rim of the opening of the slurry coater;

a carrier film holding member for holding a carrier film for forming a ceramic green sheet made from the ceramic slurry on the carrier film, the carrier film holding member is arranged such that the carrier film is pressed to the fringe part of the opening of the slurry room so as to close the opening, wherein the carrier film is moved along the opening such that the doctor edge exists at the downstream side;

a flow rate measuring means for measuring the flow rate of the ceramic slurry actually supplied to the slurry room;

a thickness measuring means for measuring the thickness of the ceramic green sheet actually formed on the carrier film;

an appropriate flow rate data calculating means for collecting the measured data on the actual flow rate and the actual thickness of the ceramic sheet and determining the appropriate flow rate of the ceramic slurry to be supplied to the slurry room for obtaining a ceramic green sheet with a desired thickness based on the measured actual flow rate data and the actual thickness data; and a flow rate controlling means for controlling the flow rate of the ceramic slurry to be supplied to the slurry room based on the appropriate flow rate data.

4. The apparatus for producing a ceramic green sheet according to claim 3, wherein the slurry room comprises:

a first slurry room;

a slurry channel communicating with the first slurry room, the slurry channel having a cross-section smaller than that of the first slurry room; and a second slurry room communicating with the slurry channel, the second slurry room having a cross-section larger than that of the slurry channel so that the ceramic slurry supply is received at the first slurry room and the opening is formed in the second slurry room.

5. The apparatus for producing a ceramic green sheet according to claim 4, wherein the flow rate measuring means includes a mass flow meter.

6. The apparatus for producing a ceramic green sheet according to claim 4, wherein the thickness measuring means includes a non-contact type film thickness-meter.

7. The apparatus for producing a ceramic green sheet according to claim 4, wherein the carrier film holding member comprises:

a backing roll disposed such that the opening of the slurry room can be closed by pressing the carrier film onto the fringe part of the opening of the slurry room while keeping the carrier film on the peripheral surface thereof, the backing roll moves the carrier film in the direction such that the doctor edge exists at the downstream side.

8. The apparatus for producing a ceramic green sheet according to claim 3, wherein the flow rate measuring means includes a mass flow meter.

9. The apparatus for producing a ceramic green sheet according to claim 8, wherein the carrier film holding member comprises:

a backing roll disposed such that the opening of the slurry room can be closed by pressing the carrier film onto the fringe part of the opening of the slurry room while keeping the carrier film on the peripheral surface thereof, the backing roll moves the carrier film in the direction such that the doctor edge exists at the downstream side.

10. The apparatus for producing a ceramic green sheet according to claim 3, wherein the thickness measuring means includes a non-contact type film thickness-meter.

11. The apparatus for producing a ceramic green sheet according to claim 10, wherein the carrier film holding member comprises:

a backing roll disposed such that the opening of the slurry room can be closed by pressing the carrier film onto the fringe part of the opening of the slurry room while keeping the carrier film on the peripheral surface thereof, the backing roll moves the carrier film in the direction such that the doctor edge exists at the downstream side.

12. The apparatus for producing a ceramic green sheet according to claim 3, wherein the carrier film holding member comprises:

a backing roll disposed such that the opening of the slurry room can be closed by pressing the carrier film onto the fringe part of the opening of the slurry room while keeping the carrier film on the peripheral surface thereof, the backing roll moves the carrier film in the direction such that the doctor edge exists at the downstream side.

* * * * *

UNITED STATES PATENT AND TRADEMARK OFFICE

CERTIFICATE OF CORRECTION

PATENT NO. : 6,096,370

DATED : August 1, 2000

INVENTOR(S) : MORI, et al.

It is certified that error appears in the above-identified patent and that said Letters Patent is hereby corrected as shown below:

[75] Name of third inventor is corrected to: Makoto MURANAKA

Signed and Sealed this

Twenty-second Day of May, 2001

*Attest:*

Nicholas P. Godici

NICHOLAS P. GODICI

*Attesting Officer*

*Acting Director of the United States Patent and Trademark Office*